US005114325A

United States Patent [19]

Morita

[11] Patent Number: 5,114,325

[45] Date of Patent: May 19, 1992

[54] ROTARY INTERNAL GEAR PUMP HAVING TEETH WITH ASYMMETRICAL TRAILING EDGES

[75] Inventor: Shoji Morita, Kanagawa, Japan

[73] Assignee: Atsugi Motor Parts Company, Limited, Kanagawa, Japan

[21] Appl. No.: 547,590

[22] Filed: Jul. 2, 1990

Related U.S. Application Data

[63] Continuation of Ser. No. 154,053, Feb. 9, 1988, abandoned.

[30] Foreign Application Priority Data

Jul. 27, 1987 [JP] Japan ..... 62-187279

[51] Int. Cl.[5] ..... F04C 2/10

[52] U.S. Cl. ..... 418/171; 418/190

[58] Field of Search ..... 418/150, 166, 171, 190

[56] References Cited

U.S. PATENT DOCUMENTS 2,389,728 11/1945 Hill ..... 418/166
2,434,135 1/1948 Witchger ..... 418/171
2,830,542 4/1958 Erickson et al. ..... 418/171
3,536,426 10/1970 Albrecht et al. ..... 418/166
4,155,686 5/1979 Eisenmann et al. ..... 418/190

FOREIGN PATENT DOCUMENTS 57-79290 5/1982 Japan .
61-8484 1/1986 Japan .
1142156 2/1969 United Kingdom ..... 418/190
1316934 5/1973 United Kingdom ..... 418/171

OTHER PUBLICATIONS

Hill, *Kinematics of Gerotors,* The Peter Reilly Co, Philadelphia, 1927, pp. 29–30, copy in 418–171.

*Primary Examiner*—John J. Vrablik
*Attorney, Agent, or Firm*—Bachman & LaPointe

[57] ABSTRACT

A trochoid type gear pump features an outer rotor formed with internal teeth and an inner rotor formed with external teeth which can be receivable in the external ones. The profiles of one or both of the internal and external teeth are rendered asymmetric and arranged to engage only in the region of an intake opening formed in the casing in which the two rotors are housed.

8 Claims, 3 Drawing Sheets

ROTARY INTERNAL GEAR PUMP HAVING TEETH WITH ASYMMETRICAL TRAILING EDGES

This is a continuation of application Ser. No. 154,053 filed Feb. 9, 1988, abandoned.

BACKGROUND OF THE INVENTION

1. Field of the Invention

The present invention relates generally to automotive lubrication system and more specifically to an oil pump which is suitable for use therein.

2. Description of the Prior Art

FIG. 1 shows a prior art trochoid type oil pump of the nature disclosed in Utility Model Publication JUM-A-59-88288. In this arrangement a pump casing 1 is formed with crescent shaped induction and discharge openings 2 and 3 respectively. An inner rotor 5 is mounted on an eccentric drive shaft 4 for synchronous rotation therewith and disposed within a ring shaped outer rotor 6.

In this arrangement the inner rotor is formed with 4 "external" teeth 7 while the outer rotor is formed with 5 "internal" teeth 8. With this arrangement when the drive shaft 4 is rotated by a non-illustrated connection with a prime mover such as an internal combustion engine, the inner and outer rotors rotate in unison. The inner rotor 4 moves within the outer rotor 6 in a manner to define spaces 9 into which oil from the induction opening 2 can enter and be retained in as they pass of the same. As the rotation of the rotors continues the spaces 9 are sequentially moved toward the discharge opening 3 and the oil which is inducted is subsequently compressed and squeezed out therethrough.

However, this arrangement has suffered from the drawback that during the rotation of the teeth of the inner and outer rotors come into mutual contact with one another and especially in the region of the discharge opening 3. Further, as each of the spaces 9 are isolated from one another some of the oil enclosed therein tends to get trapped and as the pulsation of the pump is extremely large, resonance noise tends to be generated.

In a second prior art arrangement of the nature disclosed in JP-A-57-79290 the oil pump has been constructed so that the teeth on the inner and outer rotors have asymmetrical profiles and wherein the contact ratio is less than 1. However, with this arrangement the curvature of the profile, that is to say, the radius of curvature of the faces and the top land portions of the teeth are extremely limited and machining of the the same requires a large number of intricate operations and precision machining. Even then the contact ratio of the internal and external teeth is less than one and in response to minor changes in rotation of the outer rotor the generation of relatively loud chattering noise is induced.

SUMMARY OF THE INVENTION

It is an object of the present invention to provide a gear pump for use in automotive lubrication systems or the like which exhibits smooth low vibration operation and which is readily fabricated.

In brief, the above object is achieved by a trochoid type gear pump arrangement which features an outer rotor formed with internal teeth and an inner rotor formed with external teeth which can be receivable in the external ones. The profiles of one or both of the internal and external teeth are rendered asymmetric and arranged to engage only in the region of an intake opening formed in the casing in which the two rotors are housed.

More specifically, the present invention takes the form of a pump which features a casing, the casing having an inlet opening and a discharge opening; an outer rotor rotatably disposed in a recess formed in the casing, the inner rotor being formed with a plurality of internal teeth, the inner teeth being each defined by a shaped convex recess formed in the inner periphery of the outer rotor, the internal teeth having a leading edge and trailing edge, the leading edge preceeding the trailing edge in the direction of rotation; an inner rotor disposed within the outer rotor, the inner rotor being formed with a plurality of external teeth, the external teeth being defined by shaped convex projections which extend from the outer periphery of the inner rotor, the external teeth having a leading edge and a trailing edge, the external teeth being receivable in the internal teeth so that the leading edge of the external teeth are engageable with the leading edge of the internal teeth in the region of the inlet opening; and means defining an asymmetry in at least one of the trailing edges of the internal and external teeth.

According to another aspect of the invention, a fluid pump comprises a casing, the casing having an inlet opening and a discharge opening, an outer rotor rotatably disposed in a recess formed in the casing, the outer rotor being formed with a plurality of internal teeth having a leading edge and trailing edge, the leading edge preceeding the trailing edge in the direction of rotation, the outer rotor being rotatable about a first axis, an inner rotor disposed within the outer rotor, the inner rotor being formed with a plurality of external teeth having a leading edge and a trailing edge, the external teeth being receivable in the internal teeth so that the leading edge of the external teeth are engageable with the leading edge of the internal teeth in the region of the inlet opening, the inner rotor being rotatable about a second axis which is offset from the first axis, and means defining an asymmetry in at least one of the trailing edges of the internal and external teeth.

According to a further aspect of the invention, a fluid pump comprises a casing, the casing having an inlet opening and a discharge opening, an outer rotor rotatably disposed in a recess formed in the casing, the outer rotor being formed with a plurality of internal teeth having a leading edge and trailing edge, the leading edge preceeding the trailing edge in the direction of rotation, the outer rotor being rotatable about a first axis, an inner rotor disposed within the outer rotor, the inner rotor being formed with a plurality of external teeth having a leading edge and a trailing edge, the inner rotor being rotable about a second axis which is so oriented that the external teeth being receivable in the internal teeth so that the leading edge of the external teeth are engageable with the leading edge of the internal teeth in the region of the inlet opening, and means defining an asymmetry in at least one of the trailing edges of the internal and external teeth.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENTS

Figure 3:
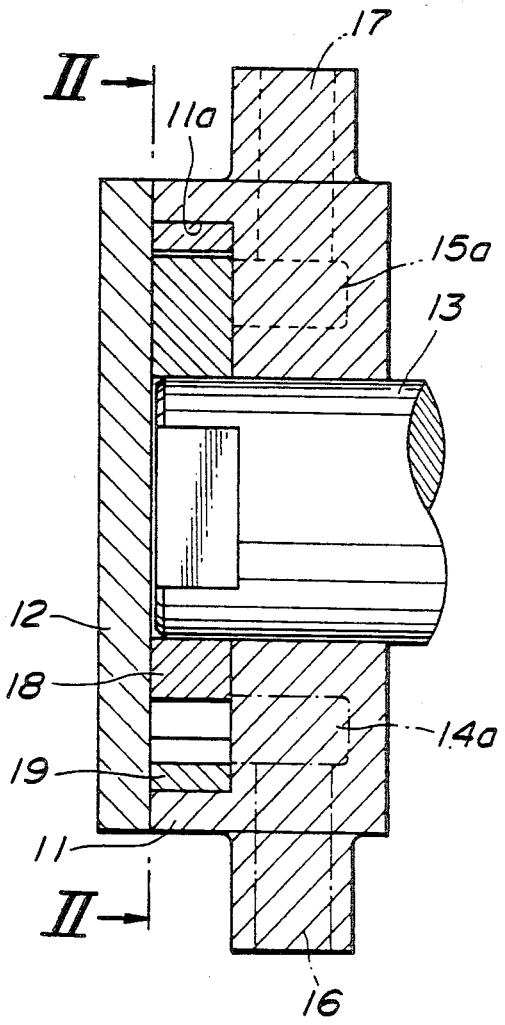
FIG. 3 is a side sectional elevation of a first embodiment of the present invention.
Figure 4:
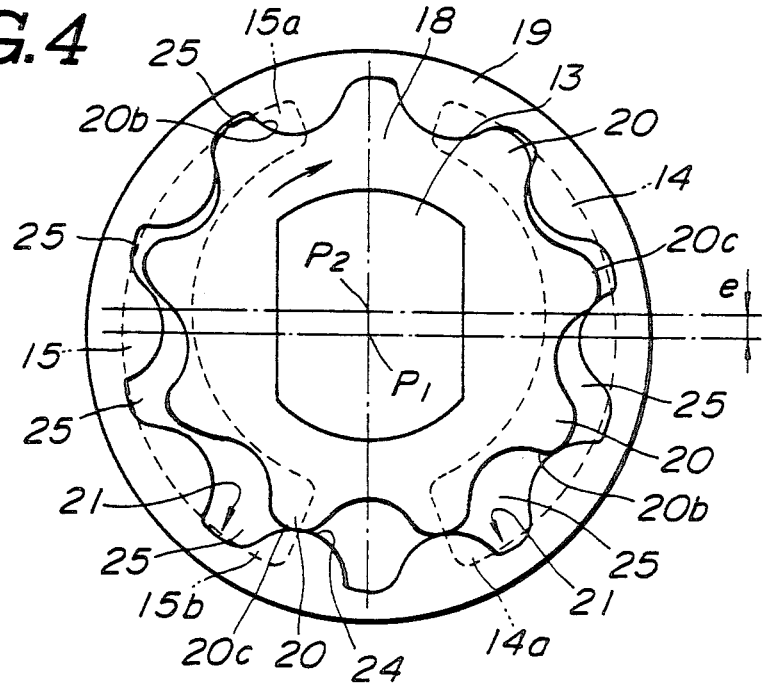
FIG. 4 is a front elevation as seen along along line IV—IV of FIG. 3.

FIGS. 3 and 4 of the drawings show a first embodiment of the present invention. In this arrangement a pump casing 12 is formed with a circular chamber 11*a* which is closed by a cover 12. An eccentric drive shaft 13 is disposed through a bore formed in the casing 12 and arranged to extend into the circular chamber 11*a*.

The casing 12 is further formed with essentially diametrically located induction and discharge openings 14 and 15. These openings respectively communicate with induction and discharge ports 16 and 17 via cavities 14*a* and 15*a*.

Inner and outer rotors 18 and 19 are operatively disposed in the circular chamber 11*a* so as to be rotatable therein. The inner rotor 18 is fixed to the drive shaft 13 for synchronous rotation therewith.

The outer rotor 19 is arranged to rotate about an axis P1 and the inner rotor 19 is arranged to rotate about an axis P2 which is offset from P1 by an amount "e" (see FIG. 4). The inner rotor 18 is formed with nine "external" teeth 20 in its outer periphery, while outer rotor 19 is formed with 10 "internal" teeth 21 about its inner periphery.

The inner and outer rotors 18 and 19 are arranged to mesh with one another to define 10 individual working spaces or chambers 25 therebetween.

Figure 1:
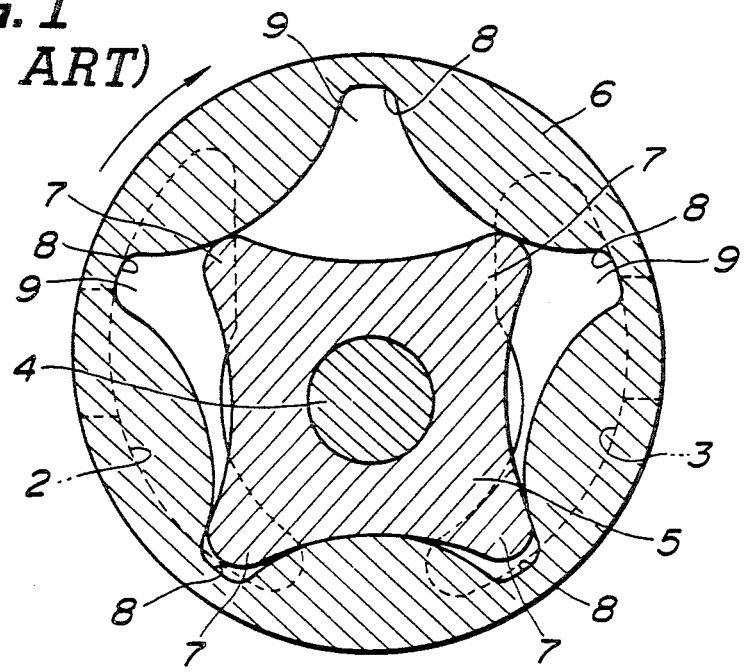
FIG. 1 (PRIOR ART)
FIG. 1 is a front sectional elevation of the first prior art arrangement discussed in the opening paragraphs of the instant disclosure.
Figure 2:
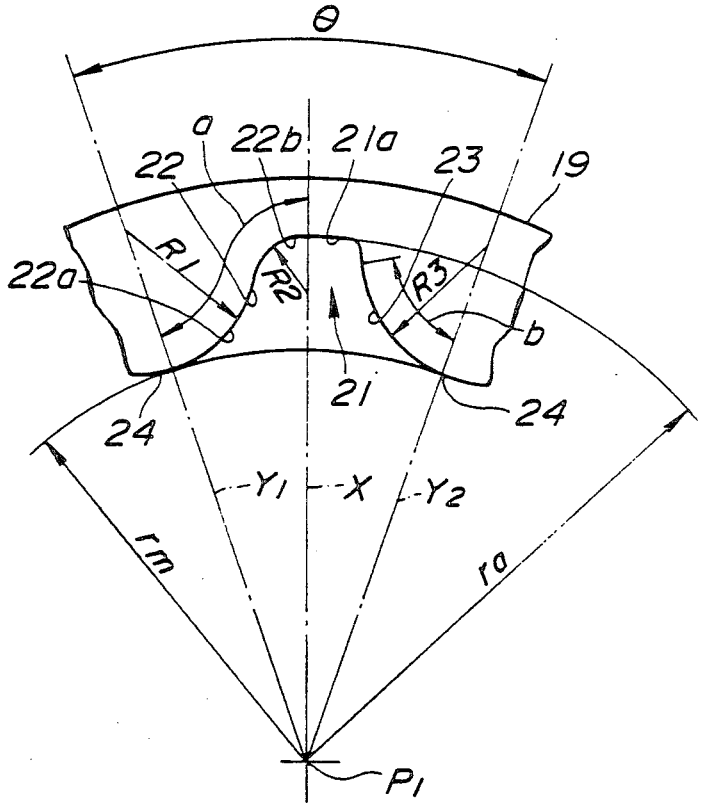
FIG. 2 is a diagram showing details of the tooth profile which characterizes the present invention.

The so called "internal" teeth 21 of the outer rotor 19 are defined by shaped recesses formed in the inner periphery of the outer rotor 19, and as shown in FIG. 2, are each arranged so that a tooth profile center line X divides each tooth into what shall be referred to as a trailing edge 22 and a top land portion 21*a* and a leading edge 23 portion. In this instance the leading edge 23 is defined from the center line in the direction of rotation while the trailing edge is defined from the center line in the direction opposite that of rotation.

Lines Y1 and Y2 are drawn so as to have their origins coincident with the axis P1 and pass through points which lie on the central portions of convex portions 24 which are located on either side of a tooth. Lines Y1 and Y2 define an included angle "$\theta$" therebetween.

The curvature "a" of the trailing edge 22 is such that the first portion 22*a* thereof has a radius of curvature R1 the origin of which lies on line Y1, while the second portion 22*b* has a radius of curvature R2 the origin of which lies on the center line X.

The top land section 21*a* of the tooth follows from the center line X and blends with a convex portion having a curvature "b". In this instance curvature "b" has a radius of curvature R3 the origin of which lies on line Y2. surface 23 having the radius R3 acts as a contact surface and engages the corresponding leading surface 20*b* of the external teeth 20 and that, at any one time, only a limited number of surfaces are in actual engagement.

In operation, the above described arrangement is such that when the drive shaft 13 is rotated in the clockwise direction, the inner rotor 18 is forced to rotate in unison. In the region of the intake opening 14, the leading surfaces 20*b* of the external teeth 20 contact the corresponding leading edges 23 of the internal teeth 21 and induces the outer rotor 19 to rotate in the same direction. Under these conditions smooth collision free engagement between the teeth on the inner and outer rotors 18, 19 occurs in the region of the intake opening 14 and a contact ratio of more than 1 is developed. Accordingly, chattering noise and the like is not generated when the outer rotor 19 undergoes slight changes in rotational speed.

Simultaneously, in the induction opening zone, lubricant enters into the chambers 25 defined between the inner and outer rotors and carried around to the exhaust opening side. As shown in FIG. 4, as each working chamber 25 approaches the wide upstream end 15*b* of the discharge opening 15, the top land sections 20*c* engage the tops of the convex sections 24. Following this, as the chambers 25 approach the narrow downstream end 15*a* of the discharge opening the external teeth begin to deeply enter the internal ones and reduce the volume of the chambers 25. At this time the leading edges 20*b* of the external teeth begin to engage the leading edges of the internal teeth and the volume of the chambers 25 reduces toward zero.

This operation allows the oil in the chambers to be smoothly displaced and prevents any undesirable retention of oil therein from occuring. Further, as the number of surfaces in actual engagement at any one moment are limited and no collisions between teeth occur with this arrangement, the pump casing vibration which leads to the generation of resonance noise is adequately reduced.

Moreover, as the curvature of the leading and trailing edges of the teeth can be selected relatively freely the production of the above described arrangement is readily produced.

Figure 5:
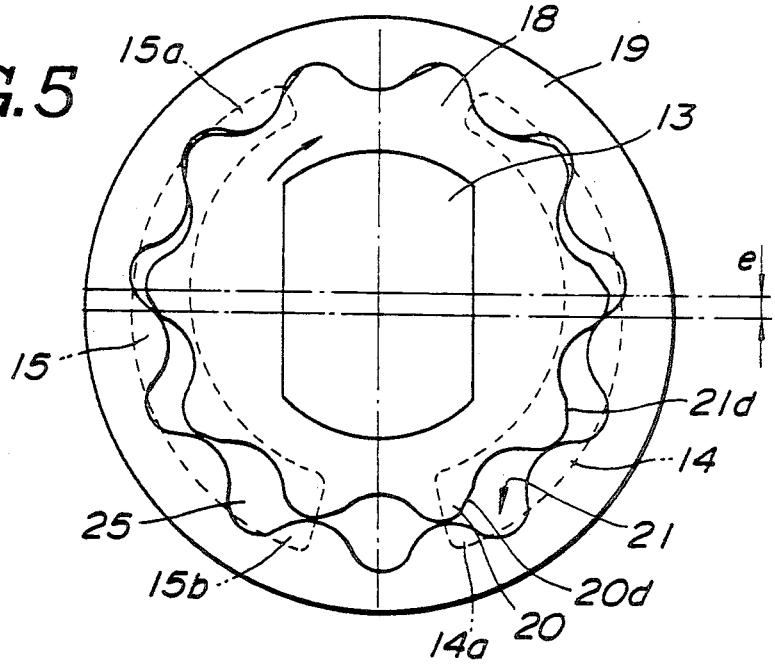
FIG. 5 is a front elevation similar to that shown in FIG. 4 which shows a second embodiment of the present invention.

FIG. 5 shows a second embodiment of the present invention. In this arrangement the inner and outer teeth profiles are formed so that the leading and trailing edges thereof are basically symmetrical in shape similar to the prior art. However, in this embodiment the external teeth are modified by removing part of the trailing surface. In this instance a flat 20*d* is ground or otherwise formed on the trailing edge of each tooth. Alternatively, as a variant of the second embodiment it is possible to form flats on the corresponding surfaces of the internal teeth in lieu of, or in addition to, the external ones if so desired.

The operation and effect of this embodiment is essentially similar to the first one.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A fluid pump comprising:

a casing having an inlet opening and a discharge opening, said casing being formed with a recess;

an outer rotor rotatably disposed in said recess formed in said casing, said outer rotor being formed with a plurality of internal teeth, each of said internal teeth having a leading edge and a trailing edge, said leading edge preceding said trailing edge in a direction of rotation of said outer rotor, said outer rotor being rotatable about a first axis;

an inner rotor disposed within said outer rotor, said inner rotor being formed with a plurality of external teeth, each of said external teeth having a leading edge and a trailing edge, said external teeth being receivable in said internal teeth, said inner rotor being rotatable about a second axis which is offset from said first axis;

said internal teeth of said outer rotor and said external teeth of said inner rotor being formed in a convex-shaped configuration;

said trailing edge of each of said internal teeth being profiled so as to have a first convexly curved portion which has a first radius of curvature, and a second concavely curved portion which merges with said first convexly curved portion, said second concavely curved portion having a second radius of curvature, the origin of said first radius of curvature falling on a first imaginary line, said first imaginary line having an origin coincident with said first axis and which passes through a point on the inner periphery of said outer rotor which defines the beginning of the profile of said outer rotor and which defines the beginning of the profile of one of said internal teeth, said second radius of curvature having an origin which lies on a second imaginary line, said second imaginary line having an origin which is coincident with said first axis and which passes through essentially the mid point of said one internal tooth; and said leading edge of each of said internal teeth including a top land portion and a third convexly curved portion, said third convexly curved portion having a third radius of curvature, said third radius of curvature having an origin which lies on a third imaginary line which has an origin coincident with said first axis and which passes through a point on the inner periphery of said inner rotor which defines the end of the profile of said one internal tooth.

2. A fluid pump comprising:

a casing having an inlet opening and a discharge opening;

an outer rotor rotatably disposed in a recess formed in said casing, said outer rotor being formed with a plurality of internal teeth, each of said internal teeth having a leading edge and a trailing edge, said leading edge preceding said trailing edge in a direction of rotation of said outer rotor, said outer rotor being rotatable about a first axis;

an inner rotor disposed within said outer rotor, said inner rotor being formed with a plurality of external teeth, each of said external teeth having a leading edge and a trailing edge, said external teeth being receivable in said internal teeth said inner rotor being rotatable about a second axis which is offset from said first axis;

said internal teeth of said outer rotor and said external teeth of said inner rotor being formed in a convex-shaped configuration;

said trailing edge of each of said internal teeth being profiled so as to have a first convexly curved portion which has a first radius of curvature, and a second concavely curved portion which merges with said first convexly curved portion, said second concavely curved portion having a second radius of curvature, the origin of said first radius of curvature falling on a first imaginary line, said first imaginary line having an origin coincident with said first axis and which passes through a point on the inner periphery of said outer rotor which defines the beginning of the profile of one of said internal teeth, said second radius of curvature having an origin which lies on a second imaginary line, said second imaginary line having an origin which is coincident with said first axis and which passes through essentially the mid point of said one internal tooth;

said leading edge of each of said internal teeth including a top land portion and a third convexly curved portion, said third convexly curved portion having a third radius of curvature, said third radius of curvature having an origin which lies on a third imaginary line which has an origin coincident with said first axis and which passes through a point on the inner periphery of said inner rotor which defines the end of the profile of said one internal tooth; and said external teeth of said inner rotor being profiled in a manner which corresponds to that of said internal teeth formed on the inner periphery of said outer rotor.

3. A fluid pump comprising:

a casing having an inlet opening and a discharge opening;

an outer rotor rotatably disposed in a recess formed in said casing, said outer rotor being formed with a plurality of internal teeth, each of said internal teeth being defined by a shaped convex recess formed in the inner periphery of said outer rotor, said internal teeth having a leading edge and a trailing edge, said leading edge preceding said trailing edge in a direction of rotation of said outer rotor, said outer rotor being rotatable about a first axis;

an inner rotor disposed within said outer rotor, said inner rotor being formed with a plurality of external teeth, said external teeth being defined by shaped convex projections which extend from the outer periphery of said inner rotor, said external teeth having a leading edge and a trailing edge, said external teeth being receivable in said internal teeth so that the leading edge of said external teeth are engageable with the leading edge of said internal teeth in the region of said inlet opening, said inner rotor being rotatable about a second axis which is offset from said first axis;

said trailing edge of each of said internal teeth being profiled so as to have a first convexly curved portion which has a first radius of curvature, and a second concavely curved portion which merges with said first convexly curved portion, said second concavely curved portion having a second radius of curvature, the origin of said first radius of curvature falling on a first imaginary line, said first imaginary line having an origin coincident with said first axis and which passes through a point on the inner periphery of said outer rotor which defines the beginning of the profile of one of said internal teeth, said second radius of curvature having an origin which lies on a second imaginary line, said second imaginary line having an origin which is coincident with said first axis and which passes through essentially the mid point of said one internal tooth; and said leading edge of each of said internal teeth including a top land portion and a third convexly curved portion, said third convexly curved portion having a third radius of curvature, said third radius of curvature having an origin which lies on a third imaginary line which has an origin coincident with said first axis and which passes through a point on the inner periphery of said internal rotor which defines the end of the profile of said one internal tooth.

4. A fluid pump comprising:

a casing having an inlet opening and a discharge opening;

an outer rotor rotatably disposed in a recess formed in said casing, said outer rotor being formed with a plurality of internal teeth, each of said internal teeth being defined by a shaped convex recess formed in the inner periphery of said outer rotor, said internal teeth having a leading edge and a trailing edge, said leading edge preceding said trailing edge in a direction of rotation of said outer rotor, said outer rotor being rotatable about a first axis;

an inner rotor disposed within said outer rotor, said inner rotor being formed with a plurality of external teeth, said external teeth being defined by shaped convex projections which extend from the outer periphery of said inner rotor, said external teeth having a leading edge and a trailing edge, said external teeth being receivable in said internal teeth so that the leading edge of said external teeth are engageable with the leading edge of said internal teeth in the region of said inlet opening, said inner rotor being rotatable about a second axis which is offset from said first axis;

said trailing edge of each of said internal teeth being profiled so as to have a first convexly curved portion which has a first radius of curvature, and a second concavely curved portion which merges with said first convexly curved portion, said second concavely curved portion having a second radius of curvature, the origin of said first radius of curvature falling on a first imaginary line, said first imaginary line having an origin coincident with said first axis and which passes through a point on the inner periphery of said outer rotor which defines the beginning of the profile of one of said internal teeth, said second radius of curvature having an origin which lies on a second imaginary line, said second imaginary line having an origin which is coincident with said first axis and which passes through essentially the mid point of said one internal tooth;

said leading edge of each of said internal teeth including a top land portion and a third convexly curved portion, said third convexly curved portion having a third radius of curvature, said third radius of curvature having an origin which lies on a third imaginary line which has an origin coincident with said first axis and which passes through a point on the inner periphery of said inner rotor which defines the end of the profile of said one internal tooth; and said external teeth of said inner rotor being profiled in a manner which corresponds to that of said internal teeth formed on the inner periphery of said outer rotor.

5. A fluid pump comprising:

a casing having an inlet opening and a discharge opening;

an outer rotor rotatably disposed in a recess formed in said casing, said outer rotor being formed with a plurality of internal teeth, each of said internal teeth having a leading edge and a trailing edge, said leading edge preceding said trailing edge in a direction of rotation of said outer rotor, said outer rotor being rotatable about a first axis;

an inner rotor disposed within said outer rotor, said inner rotor being formed with a plurality of external teeth, each of said external teeth having a leading edge and a trailing edge, said inner rotor being rotatable about a second axis which is so oriented that said external teeth are receivable in said internal teeth so that the leading edge of said external teeth are engageable with the leading edge of said internal teeth in the region of said inlet opening;

said internal teeth of said outer rotor and said external teeth of said inner rotor being formed in a convex-shaped configuration; and said trailing edge of each of said internal teeth being profiled so as to have a first convexly curved portion which has a first radius of curvature, and a second concavely curved portion which merges with said first convexly curved portion, said second concavely curved portion having a second radius of curvature, the origin of said first radius of curvature falling on a first imaginary line, said first imaginary line having an origin coincident with said first axis and which passes through a point on the inner periphery of said outer rotor which defines the beginning of the profile of one of said internal teeth, said second radius of curvature having an origin which lies on a second imaginary line, said second imaginary line having an origin which is coincident with said first axis and which passes through essentially the mid point of said one internal tooth; and said leading edge of each of said internal teeth including a top land portion and a third convexly curved portion, said third convexly curved portion having a third radius of curvature, said third radius of curvature having an origin which lies on a third imaginary line which has an origin coincident with said first axis and which passes through a point of the inner periphery of said inner rotor which defines the end of the profile of said one internal tooth.

6. A fluid pump comprising:

a casing having an inlet opening and a discharge opening;

an outer rotor rotatably disposed in a recess formed in said casing, said outer rotor being formed with a plurality of internal teeth having a leading edge and a trailing edge, said leading edge preceding said trailing edge in a direction of rotation of said outer rotor, said outer rotor being rotatable about a first axis;

an inner rotor disposed within said outer rotor, said inner rotor being formed with a plurality of external teeth, each of said external teeth having a leading edge and a trailing edge, said inner rotor being rotatable about a second axis which is so oriented that said external teeth being receivable in said internal teeth so that the leading edge of said external teeth are engageable with the leading edge of said internal teeth in the region of said inlet opening;

said trailing edge of each of said internal teeth being profiled so as to have a first convexly curved portion which has a first radius of curvature, and a second concavely curved portion which merges with said first convexly curved portion, said second concavely curved portion having a second radius of curvature, the origin of said first radius of curvature falling on a first imaginary line, said first imaginary line having an origin coincident with said first axis and which passes through a point on the inner periphery of said outer rotor which defines the beginning of the profile of one of said internal teeth, said second radius of curvature having an origin which lies on a second imaginary line, said second imaginary line having an origin which is coincident with said first imaginary axis and which passes through essentially the mid point of said one internal tooth;

said leading edge of each of said internal teeth including a top land portion and a third convexly curved portion, said third convexly curved portion having a third radius of curvature, said third radius of curvature having an origin which lies on a third imaginary line which has an origin coincident with said first axis and which passes through a point of the inner periphery of said inner rotor which defines the end of the profile of said one internal tooth; and said external teeth of said inner rotor being profiled in a manner which corresponds to that of said internal teeth formed on the inner periphery of said outer rotor.

7. A fluid pump comprising:

a casing having an inlet opening and a discharge opening;

an outer rotor rotatably disposed in a recess formed in said casing, said outer rotor being formed with a plurality of internal teeth, each of said internal teeth having a leading edge and a trailing edge, said leading edge preceding said trailing edge in a direction of rotation of said outer rotor, said outer rotor being rotatable about a first axis;

an inner rotor disposed within said outer rotor, said inner rotor being formed with a plurality of asymmetric external teeth, each of said external teeth having a leading edge and a trailing edge, said external teeth being receivable in said internal teeth, said inner rotor being rotatable about a second axis which is offset from said first axis; and said leading and trailing edges of said internal teeth having essentially symmetrical shapes and said trailing edge of each of said asymmetric external teeth being formed with a flat surface.

8. A fluid pump comprising:

a casing having an inlet opening and a discharge opening;

an outer rotor rotatably disposed in a recess formed in said casing, said outer rotor being formed with a plurality of internal teeth, each of said internal teeth having a leading edge and a trailing edge, said leading edge preceding said trailing edge in a direction of rotation of said outer rotor, said outer rotor being rotatable about a first axis;

an inner rotor disposed within said outer rotor, said inner rotor being formed with a plurality of asymmetric external teeth, each of said external teeth having a leading edge and a trailing edge, said inner rotor being rotatable about a second axis which is so oriented that said external teeth are receivable in said internal teeth; and said leading and trailing edges of said internal teeth having essentially symmetrical shapes and said trailing edge of each of said asymmetric external teeth being formed with a flat surface.

* * * * *